US006362790B1

(12) United States Patent
Proctor, Jr. et al.

(10) Patent No.: US 6,362,790 B1
(45) **Date of Patent: *Mar. 26, 2002**

(54) ANTENNA ARRAY STRUCTURE STACKED OVER PRINTED WIRING BOARD WITH BEAMFORMING COMPONENTS

(75) Inventors: James A. Proctor, Jr., Indialantic; Kenneth M. Gainey, Satellite Beach, both of FL (US)

(73) Assignee: Tantivy Communications, Inc., Melbourne, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/384,041

(22) Filed: Aug. 26, 1999

Related U.S. Application Data

(60) Provisional application No. 60/100,995, filed on Sep. 18, 1998.

(51) Int. Cl.[7] ..... H01Q 1/24

(52) U.S. Cl. ..... 343/702; 343/878; 343/895

(58) Field of Search ..... 343/702, 872, 343/873, 879, 893, 895, 700 MS; 342/367

(56) References Cited

U.S. PATENT DOCUMENTS

| | | | | |
|---|---|---|---|---|
| 5,617,102 A | | 4/1997 | Prater | 342/374 |
| 5,628,053 A | | 5/1997 | Araki et al. | 455/86 |
| 5,680,144 A | | 10/1997 | Sanad | 343/700 |
| 5,973,646 A | * | 10/1999 | Engblom | 343/872 |
| 6,016,126 A | * | 1/2000 | Holshouser | 343/702 |
| 6,028,554 A | * | 2/2000 | Mandai et al. | 343/895 |
| 6,115,762 A | * | 9/2000 | Bell et al. | 343/702 |

FOREIGN PATENT DOCUMENTS

| | | |
|---|---|---|
| EP | 0 012 055 A1 | 6/1980 |
| EP | 0 793 293 A1 | 9/1997 |
| FR | 2 710 195 | 3/1995 |

OTHER PUBLICATIONS

"Helical Antenna For Cordless Phones", (HEA Series) Tokyo, Inc., pp 1–4 (1997).

"Chip Multilayer Antenna Manual", pp 1–10, Version 0.5 (1998).

Dual Band Antenna for Wireless Phones, Toyo—HAS047 Series, pp. 1–2, downloaded Jul. 16, 1998 from http://www.tokoam.com/dac_dak/has047.html.

"Application Notes for LDA Series Antennas", pp 1–6.

* cited by examiner

*Primary Examiner*—Don Wong
*Assistant Examiner*—Thuy Vinh Tran
(74) *Attorney, Agent, or Firm*—Hamilton, Brook, Smith & Reynolds, P.C.

(57) ABSTRACT

A miniaturized directional antenna for use with system to provide data communication over wireless radio channels. The unit supports multiple antenna elements with a known orientation with respect to an earth ground plane reference. This greatly provides predictability in the steerability and other directional attributes of the antenna array using miniaturized chip multilayer or helical antenna elements, the unit may be constructed in a case or other form factor of approximately 3×3×1 inches for operation within the frequency bands around 1900 MHz.

14 Claims, 6 Drawing Sheets

ANTENNA ARRAY STRUCTURE STACKED OVER PRINTED WIRING BOARD WITH BEAMFORMING COMPONENTS

RELATED APPLICATION(S)

This application claims priority to U.S. Provisional Application No. 60/100,995 filed Sep. 18, 1998, the entire teachings of which are incorporated herein by reference.

BACKGROUND OF THE INVENTION

The users of computers, Personal Digital Assistants (PDAs), and other data processing equipment increasingly rely upon various types of network connections in order to obtain access to data in various forms. For example, sophisticated business users now desire high speed Internet access whether on the road or in their home location. Corporate information technology departments often need to rapidly set up and tear down access for their users as locations change and temporary visitors need to be accommodated. In addition, organizations in the appliance repair, package delivery, and other service industries also require data access.

Although present wireless communication infrastructure such as provided by the cellular telephone network is in widespread use for voice traffic, its use has not spread in particular for data applications. This is due in part perhaps to the relatively slow available speeds for sending data over cellular connections, which supports rates of only 9600 or 14400 baud. Another consideration is convenience. For example, in order to use the cellular system, one must not only carry around a cellular telephone, but also specialized modem equipment in addition to a laptop computer or other personal computing equipment.

Digital cellular equipment typically makes use of handsets that have the traditional single dipole antenna. Unfortunately, such antenna units are not optimized for maximizing data speeds. For example, in networks that make use of Code Division Multiple Access (CDMA) signaling, power levels must be carefully controlled, especially for transmission from the subscriber back to the base station (reverse link). By optimizing the effective radiated power, data rates can be maximized.

Unfortunately, known dipole antenna arrangements, or even known combinations of dipole arrangements, do not provide adequate control over effective radiated power. This is due in part to a number of causes. Dipole antennas alone do not provide directional antenna patterns that allow the power to be more effectively directed to the base station. Moreover, implementing such devices within handset form factors, or within other form factors such as integral to the case of the computer equipment, makes it difficult to ensure that the antenna elements are properly oriented with respect to the earth.

What is needed is a small and convenient unit that can be used to provide wireless data access such as over existing cellular telephone networks. The device should have a convenient form factor such as will fit in a shirt pocket or purse.

SUMMARY OF THE INVENTION

The present invention is a miniaturized directional antenna array that can be used to provide directional gain to optimize digital data communications. The antenna array is packaged in a palm sized case which may be placed on a table or other approximately horizontal surface convenient to the portable computing equipment. The arrangement of the array elements within the case automatically provides a proper orientation of the antenna elements with respect to the earth.

In the preferred embodiment, the array is a five element array having a center element and four outlying or comer elements. The outlying elements are spaced at approximately one-quarter of a wave length radial distance from the center element. The antenna elements are fastened to an appropriate support structure disposed within the case which is formed of a convenient material such as plastic which is transparent to radio wave propagation. Other electrical elements such as strip line power dividers, phase shifter components, and power routing components are placed on a multilayer printed circuit card disposed beneath the antenna array support structure.

In the preferred embodiment, the radiating elements themselves are a type of miniaturized antenna element known as a multilayer chip antenna. Such chip antennas are extremely small in size and may be conveniently mounted within the support structures in accordance with well known manufacturing techniques.

Alternatively, the radiating elements may be helical antennas that are also mounted within the support structure with the proper vertical orientation.

The overall result is an antenna package that does not exceed approximately one (1) inch in height and three (3) inches in width and depth, which can be used to greatly enhance the radio link signaling characteristics for data signals.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
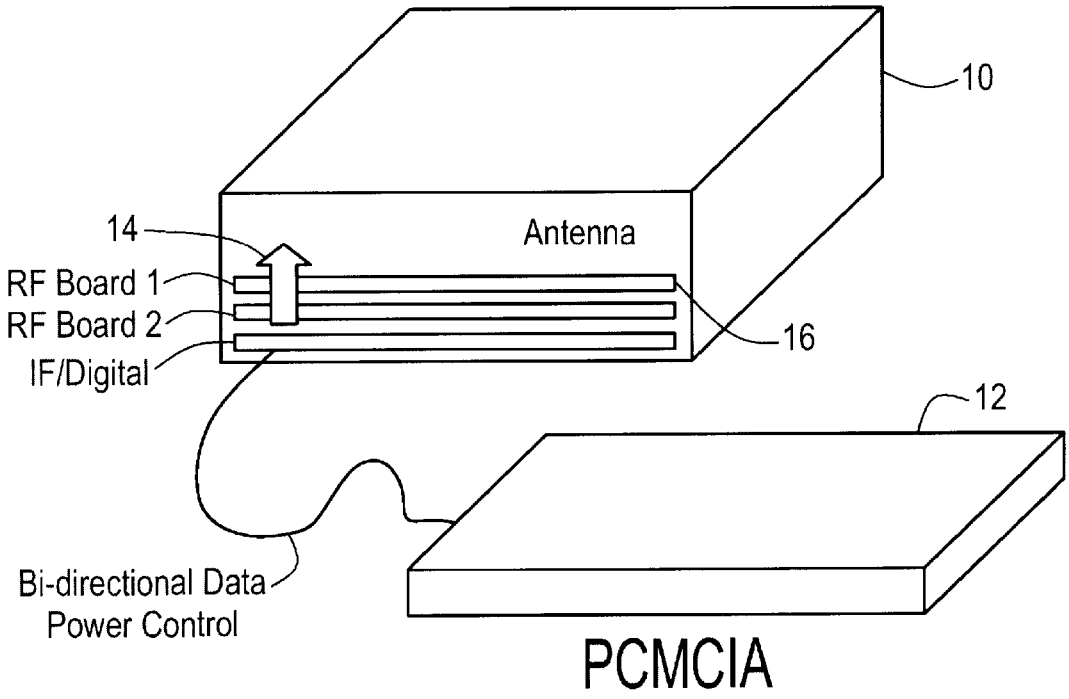
FIG. 1 is an external view of an antenna unit and a computer interface card according to the invention.

Turning attention now to the drawings, FIG. 1 is an isometric view of an antenna unit 10 according to the invention. The antenna unit 10 is a generally rectangular case formed of material such as plastic that is transparent to radio waves. The antenna unit 10 is connected via a bi-directional control cable 11 over a suitable computer interface such as a PCMCIA interface card 12.

The exterior of the antenna unit 10 is typically labeled with an indicator such as an arrow 14 to instruct the user on the proper orientation of the unit. During operation, the unit 10 is, for example, placed on a table or desk or other convenient horizontal surface and connected to the computing equipment such as a laptop portable computer, personal digital assistant (PDA), or other computing device via the PCMCIA card 12. The user ensures that the arrow is pointing in the upward direction.

The antenna unit 10 encloses not only radiating antenna elements but also circuitry including radio frequency (RF), intermediate frequency (IF), and digital circuitry on one or more layers 16 of a printed circuit board. The circuit layers 16 are generally indicated in FIG. 1, with the understanding that they may also be implemented on more than one printed circuit board.

Figure 2:
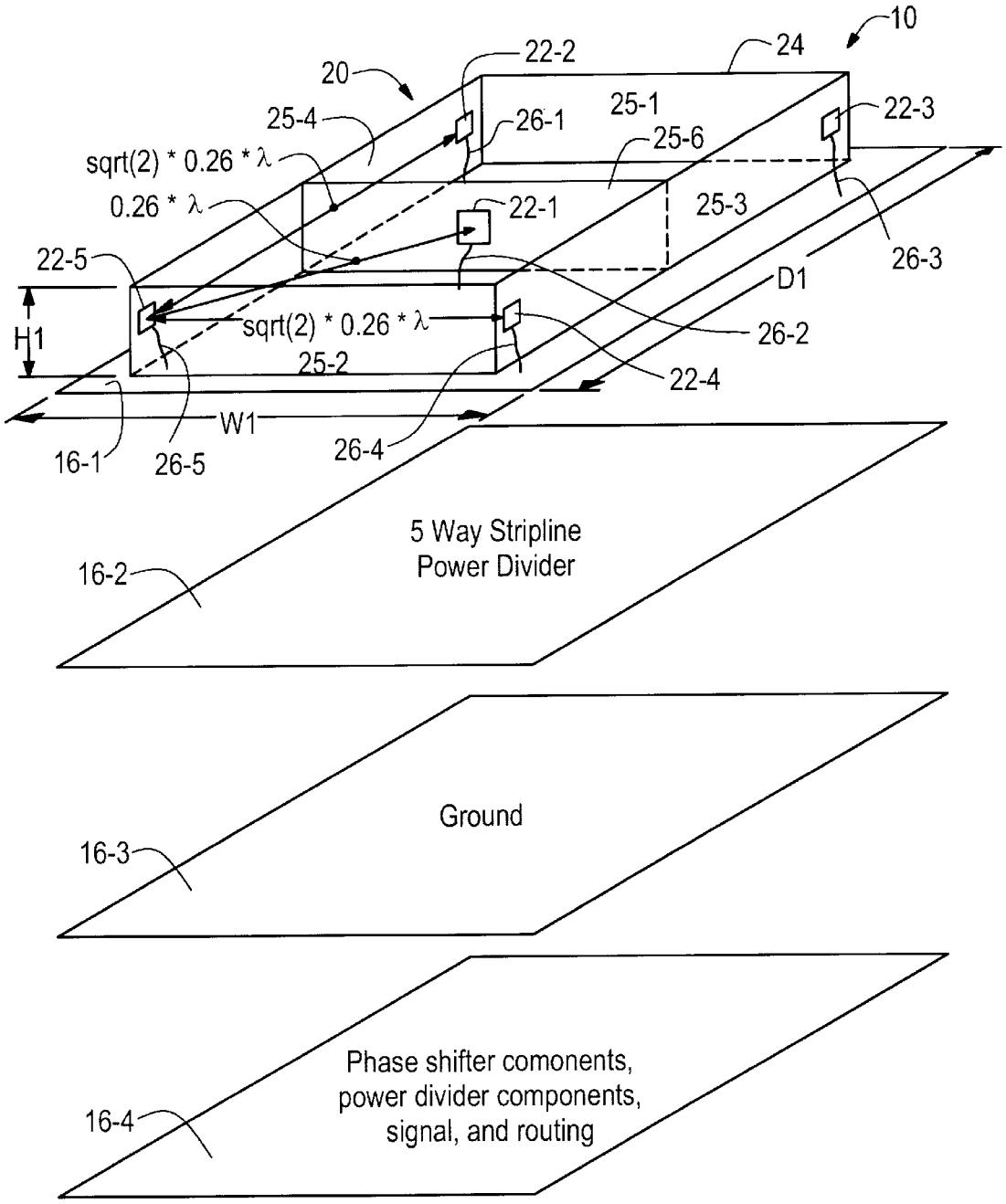
FIG. 2 is a more detailed view of the interior of the antenna unit.

FIG. 2 is a more detailed exploded view of the unit 10. The unit 10 includes within the interior thereof an antenna array 20 and multiple circuit board layers 16-1, 16-2, 16-3, and 16-4 as previously mentioned. The antenna array 20 in the preferred embodiment consists of five antenna elements 22-1, 22-2, 22-3, 22-4, and 22-5 arranged as shown. In particular, a center element 22-1 is arranged with four outlying elements 22-2, 22-3, 22-4, and 22-5 placed on the outer corners of a generally rectangular frame used as a support structure 24.

The support structure 24 consists of a number of vertically oriented surfaces including a back wall 25-1, a front wall 25-2, a right side wall 25-3, a left side wall 25-4, and a center wall 25-6. The center wall 25-6 supports the center element 22-1. The right hand wall 25-3 supports the rear right clement 22-3 and forward right element 22-4. The left wall 25-4 supports a rear left element 22-2 and a front left element 22-5.

In this embodiment, the elements 22 are chip multilayer antennas such as the model LDA36D1920 antenna available from Murata Manufacturing Company Ltd. This type of element is described in further detail in connection with FIG. 3.

The spacing between the elements 22 is critical to proper performance of the array 20. In the preferred embodiment, the spacing of the array elements 22 depends in particular upon the wavelength, $\lambda$, of the intended center frequency of operation. In the preferred embodiment of operation within the Personal Communication System (PCS) frequency bands of approximately 1850 to 1990 MHz, the wavelength $\lambda$ is approximately 6.215 inches.

In general, however, the element spacing is such that the center points of the outlying elements 22-2, . . . , 22-5 are set at a radial distance of approximately 0.26 times $\lambda$ from the center element 22-1. It should be understood that this spacing can be varied somewhat in order to obtain desired effects. The array should be a square array such that the spacing should be the same among all adjacent outer elements. For example, the best spacing between front elements 22-5 and 22-4 is approximately the square root of 0.26 times $\lambda$ which is the same as the spacing between the elements along the side elements 22-2 and 22-5. For operation at approximately 1900 MHz, the entire unit 10 is only about 3 inches by 3 inches by 1 inch high.

The support structure 24 can also be formed of any convenient material transparent to the transmission of radio waves such as plastic, ceramic, or other materials. What is important is that the support structure 24 orient the antenna elements in a predictable way with respect to the earth. Thus, when the user places the antenna unit 10 with the correct orientation as indicated by the arrow 14, the elements 22 will have a known orientation with respect to the earth, and more predictable operation results.

The array 20 also requires other components in order to properly operate. For example, the array 20 is a directional array which can be steered in a number of different directions by changing the phase of the electrical signals applied to the individual elements 22. Thus, additional components such as power dividers, phase shifters, and signal routing traces are also placed and formed within the antenna unit 10. Preferably these components are placed within one of the circuit board layers 16 as previously described. For example, an upper layer 16-1 may be a ground plane layer, and a second layer 16-2 may accommodate strip line power dividers to provide five way splitting of electrical signal energy applied to the antenna array 20. A third layer 16-3 may provide another ground plane and fourth layer 16-4 may provide a surface for mounting and interconnecting phase shifter components, additional power dividing components, and signal and power wiring.

Conductors 26-1, . . . , 26-5 are extended from a feed point of each of the elements 22-1, . . . , 22-5 to provide a connection to the electrical components such as the strip line power divider components on layer 16-2. The circuit boards 16 and/or circuit layer may be solid ground planes or have interruptions at various places to accommodate wiring.

The arrangement in FIG. 2 thus provides a structure for miniaturized antenna elements forming a steerable array which, in a relatively small package, provides a known orientation of antenna elements in order to optimize operation such as, for example, in wireless digital data networks.

Figure 3:
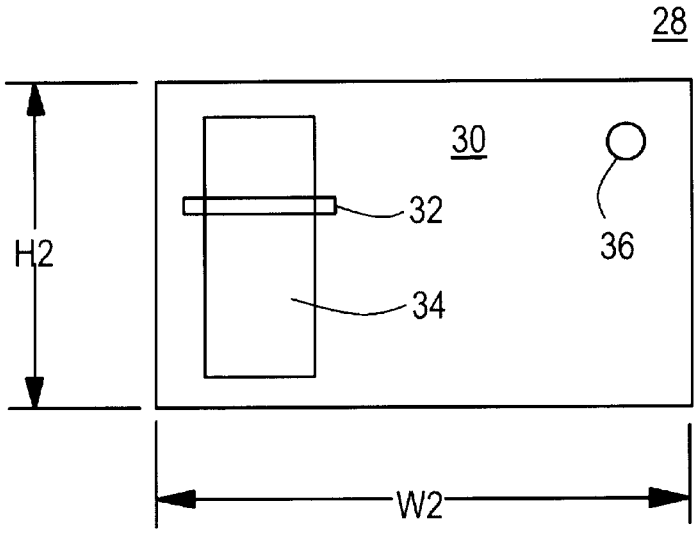
FIG. 3 is a more detailed view of a chip multi-layer antenna element.
Figure 4:
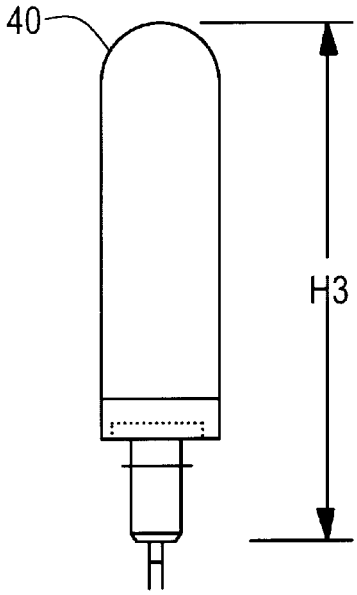
FIG. 4 is a more detailed view of a helical antenna element that may be used in the array.

FIG. 3 is a more detailed view of one of the miniature antenna elements 22. This particular element, as obtained from Murata Manufacturing Company Ltd., is a miniaturized type of antenna known as the LDA36D series. The element 22 is of the top capacitive loading type has a substrate 30 on which are formed a laser trim line 30 and internal top loading structure 34. A feed end point 36 provides a point at which a connection to a feed line can be made. The element 22 may be fabricated on a convenient material such as a ceramic substrate. The antenna element acts as a one-quarter wave length type radiating element.

In an alternative embodiment, the antenna elements 22 may be implemented as miniaturized helical antennas such as available from Toko America, Inc. Elements such as the model HEAW-T01-002 have an overall height H 3 of approximately 1.32 inches. In the case of the instance of the use of helical antennas 40, they may be mounted directly to the underlying circuit layers 16-1, and therefore do not need as elaborate a support structure 24 as in the case of the chip antennas 28. However, the structure 24 must provide a proper orientation of such helical coil antennas with respect to the earth so they will always be placed in a known orientation by the user.

Figure 5:
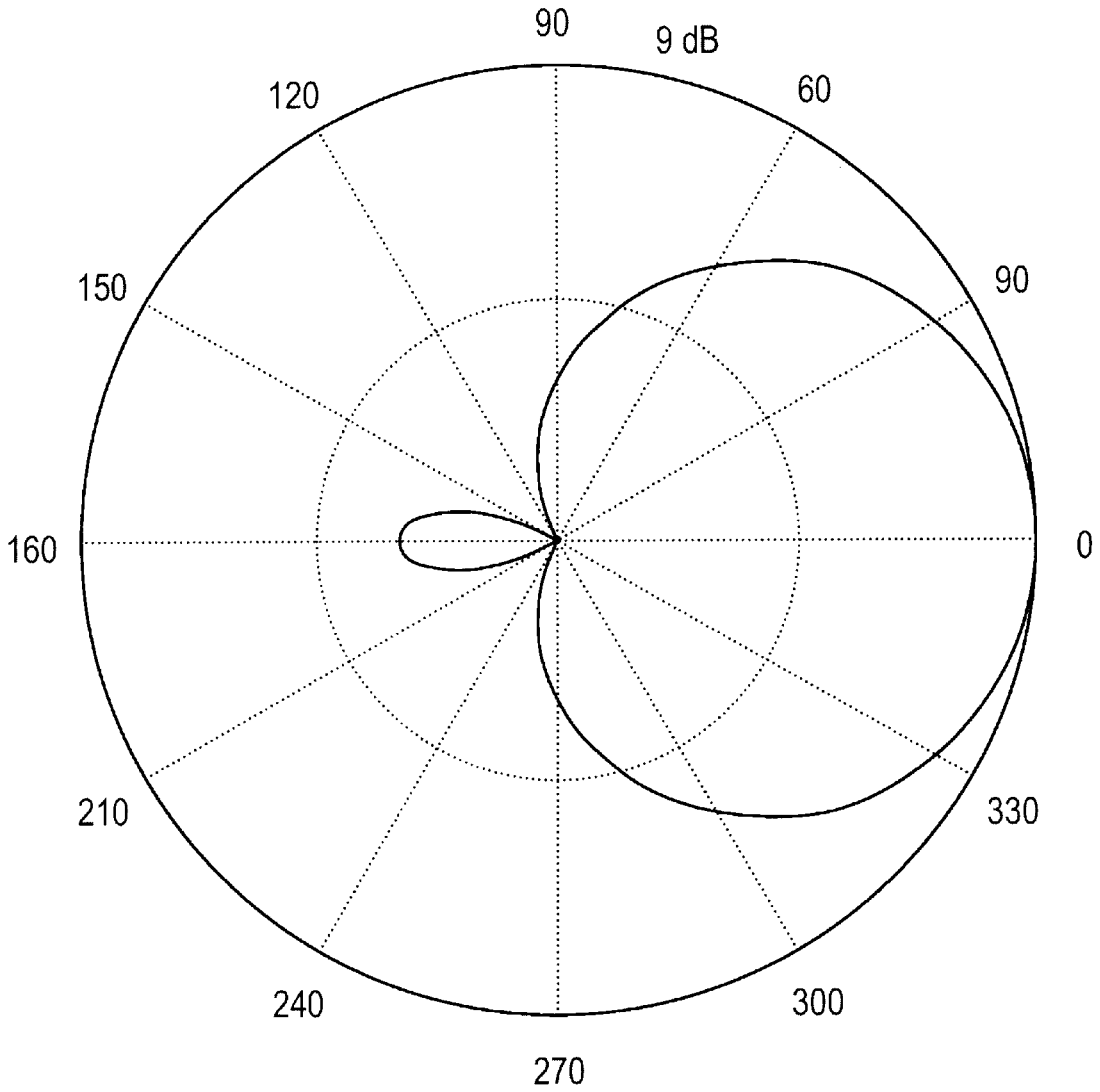
FIGS. 5, 6 and 7 are antenna patterns resulting from a simulation of an antenna array structure according to the invention.
Figure 6:
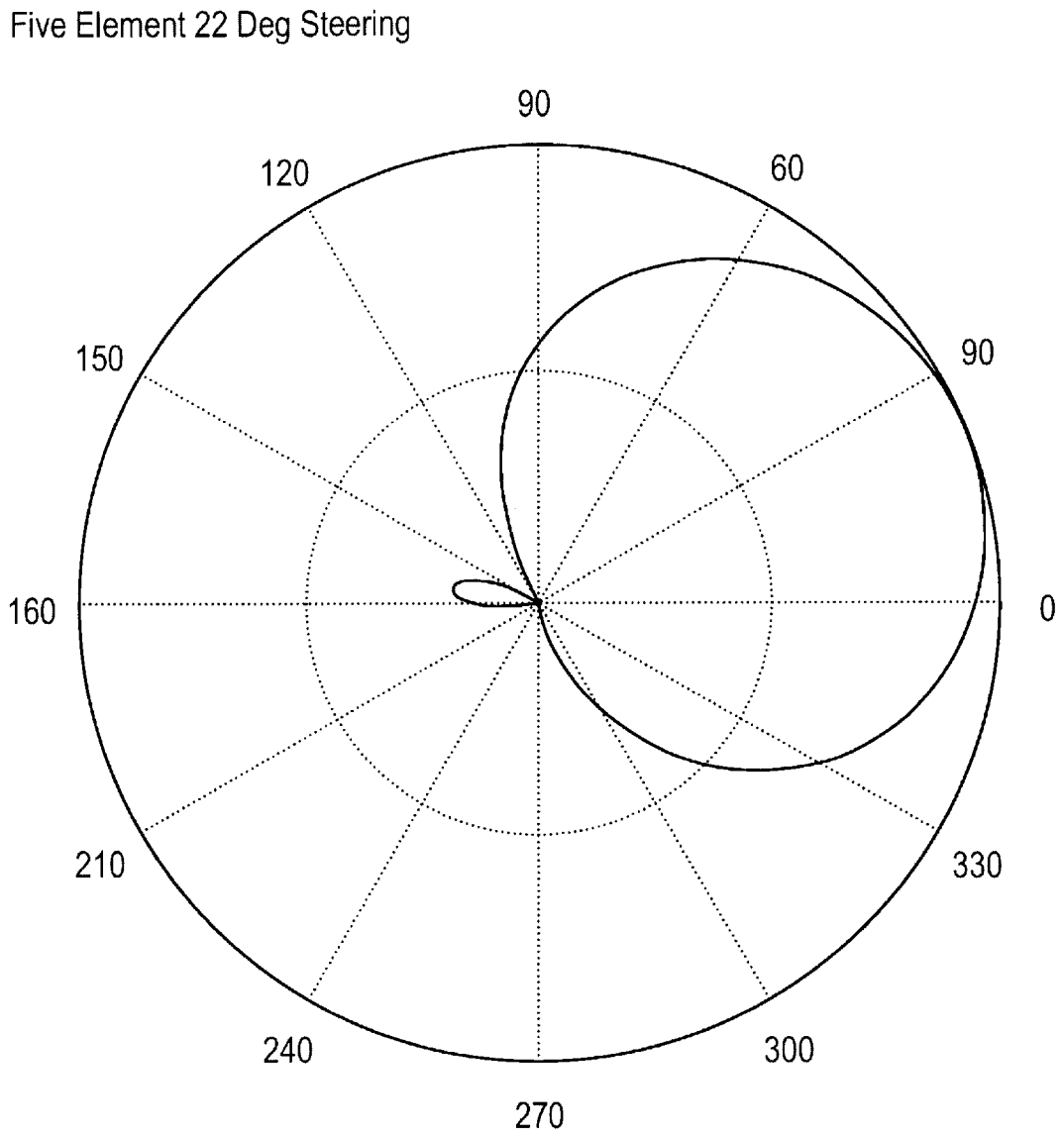
Figure 7:
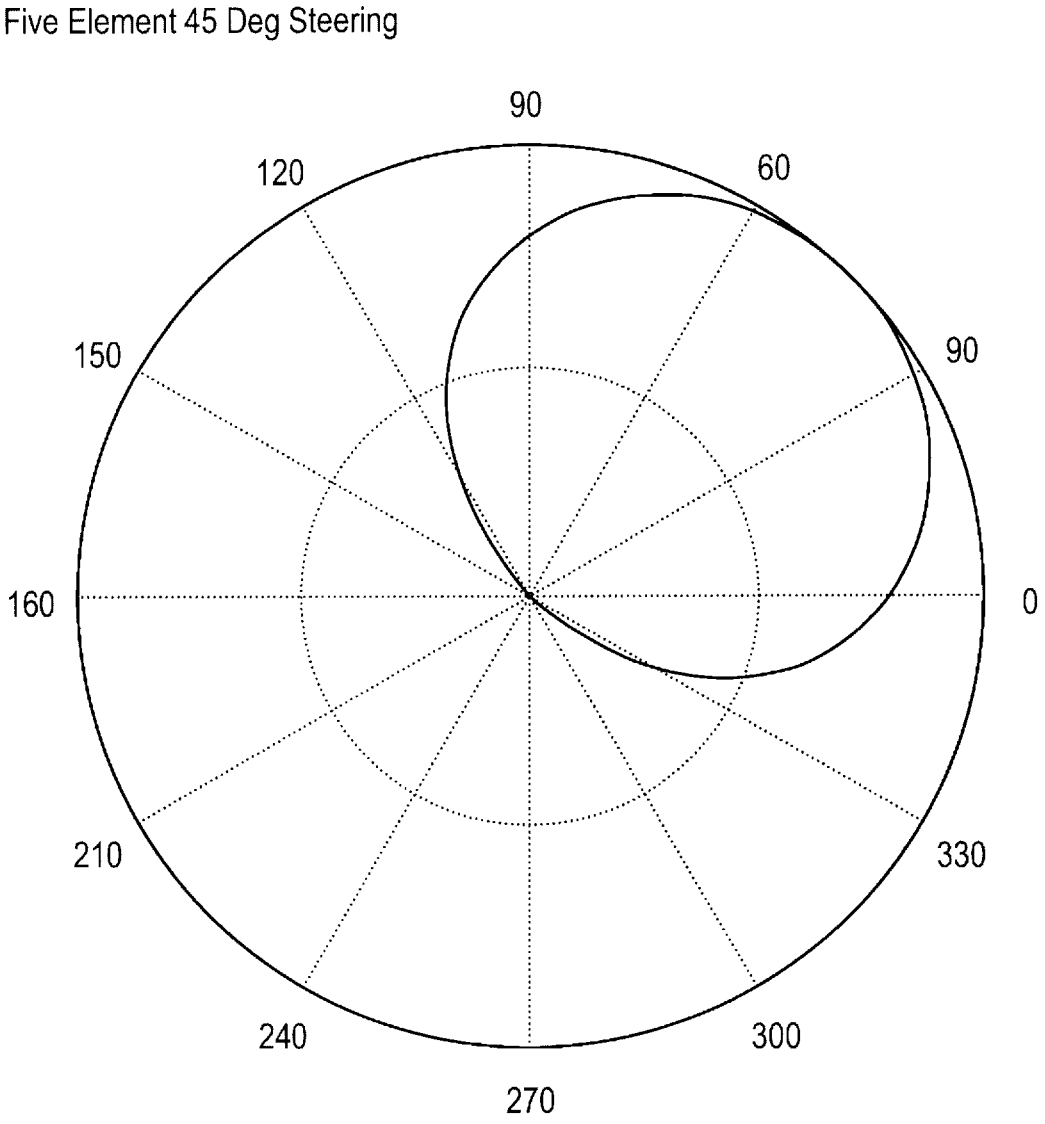

Samples of the types of antenna patterns which appear to be achievable with the antenna unit 10 are shown in FIGS. 5, 6 and 7. FIG. 5 is an antenna pattern developed from a simulation of the structure with the antenna phases set to optimize a directional orientation with respect to zero degrees. It illustrates that the geometry can be used to obtain an acceptable beamwidth of approximately 30 degrees.

FIGS. 6 and 7 show the result when the phase element weights are optimized for 22 degrees and 45 degrees steering respectively. The relative magnitude of the results of the simulation indicated an expected directional gain of approximately 9 decibels with respect to isotropic (dBi).

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A directional antenna unit for use with portable data processing equipment which provides communication of digital signals over a radio channel comprising:

a plurality of antenna elements arranged in a multidimensional array, the antenna elements disposed according to a predetermined position computed as a result of an intended wavelength;

a support structure for supporting the antenna elements in a substantially vertical orientation with respect to an earth plane reference; and directional steering circuit components mounted to a circuit board plane beneath the antenna element array, the steering circuit components operable for power control of the plurality of antenna elements;

such that the circuit board elements, support structure, and antenna elements are enclosed in a case.

2. An antenna as in claim 1 wherein the case has orientation indicia placed on an external surface thereof.

3. An antenna as in claim 1 in which there are five antenna elements, including a center element and four comer elements.

4. An antenna as in claim 3 wherein the four corner elements are spaced approximately one quarter of a wave length along a radial direction from the center element.

5. An antenna as in claim 3 wherein the four corner elements are spread apart from the center element by 0.26 of a wavelength of operation of the antenna.

6. An antenna as in claim 1 wherein the antenna elements are chip-type elements.

7. An antenna as in claim 6 wherein the support structure supports the chip-type antenna elements in an orientation which is perpendicular to the circuit board plane.

8. The antenna of claim 1 wherein the multidimensional array is a directional array.

9. The antenna of claim 1 wherein the antenna elements are substantially perpendicular to the circuit board plane.

10. The antenna of claim 1 wherein the multidimensional array is operable for point to multipoint communication.

11. A directional antenna unit operable for directional RF communication of digital signals comprising:

a housing adapted to maintain positional independence from the portable data processing equipment;

a multilayer printed circuit board in the housing comprising coplaner layers including a supporting ground plane layer, a power divider layer, a ground plane layer, and a component layer having interconnected phase shifters, power dividers, signal wiring, and power wiring;

a support structure on the multilayer printed circuit board comprising outer walls arranged in a rectangular form, the outer walls substantially perpendicular to the multilayer printed circuit board;

a center wall member substantially bisecting two opposed outer walls of the support structure;

a first antenna element and a second antenna element disposed on opposed ends of one of the outer walls bisected by the center wall member, each antenna element adjacent to a comer formed with the adjoining outer walls;

a third antenna element and a fourth antenna element disposed on opposed ends of the outer wall opposed to the outer wall having the first antenna element and the second antenna element, each antenna element adjacent to a comer formed with the adjoining outer walls; and a fifth antenna element disposed at the middle of the center wall member, each of the antenna elements disposed according to a predetermined position computed as a result of an intended wavelength, the steering circuit components operable for power control of the plurality of antenna elements.

12. The directional antenna unit of claim 11 wherein the antenna elements are chip-type elements.

13. The directional antenna unit of claim 12 wherein the support structure supports the antenna elements in an orientation perpendicular to the multilayer printed circuit board.

14. The directional antenna unit of claim 11 wherein the predetermined position of the first, second, third, and fourth antenna elements is is 0.26 the intended wavelength from the fifth element.

* * * * *

UNITED STATES PATENT AND TRADEMARK OFFICE

CERTIFICATE OF CORRECTION

PATENT NO. : 6,362,790 B1
DATED : March 26, 2002
INVENTOR(S) : James A. Proctor, Jr. and Kenneth M. Gainey It is certified that error appears in the above-identified patent and that said Letters Patent is hereby corrected as shown below:

Column 6,
Lines 20 and 26, "comer" should read -- corner --.

Signed and Sealed this

Twenty-eighth Day of May, 2002

*Attest:*

*Attesting Officer*

JAMES E. ROGAN
*Director of the United States Patent and Trademark Office*